US011327427B2

(12) United States Patent
Doi

(10) Patent No.: US 11,327,427 B2
(45) **Date of Patent: *May 10, 2022**

(54) IMAGE FORMING APPARATUS, DETERMINATION APPARATUS, AND CONTROL METHOD

(71) Applicant: TOSHIBA TEC KABUSHIKI KAISHA, Tokyo (JP)

(72) Inventor: Yayoi Doi, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/179,238

(22) Filed: Feb. 18, 2021

(65) Prior Publication Data

US 2021/0173336 A1 Jun. 10, 2021

Related U.S. Application Data

(63) Continuation of application No. 16/703,064, filed on Dec. 4, 2019, now Pat. No. 10,962,916.

(30) Foreign Application Priority Data

Feb. 5, 2019 (JP) ..... JP2019-019097

(51) Int. Cl.
*G03G 15/00* (2006.01)
*G03G 15/20* (2006.01)

(52) U.S. Cl.
CPC ..... *G03G 15/6582* (2013.01); *G03G 15/2003* (2013.01); *G03G 15/6588* (2013.01)

(58) Field of Classification Search
CPC ..... G03G 15/6582; G03G 15/2003; G03G 15/6588
See application file for complete search history.

(56) References Cited

U.S. PATENT DOCUMENTS 9,128,450 B2 9/2015 Terada
10,962,916 B2 * 3/2021 Doi ..... G03G 15/6588
(Continued)

FOREIGN PATENT DOCUMENTS

JP 2012-78498 A 4/2012

OTHER PUBLICATIONS

Extended European Search Report dated Jun. 30, 2020 in corresponding European Patent Application No. 20155419.3, 7 pages.

*Primary Examiner* — Joseph S Wong
(74) *Attorney, Agent, or Firm* — Kim & Stewart LLP

(57) ABSTRACT

An image forming apparatus includes a fixing device, an image reading unit, and a control unit. The fixing device includes a heating elements arranged in a main scanning direction, a band-shaped thin film which slides on the surface of the heating element while in contact with the heating element, and a rotatable body configured to press against a surface of the thin film to cause the thin film to rotate. The fixing device heats the heating elements when an inspection sheet is passed through the fixing device, the inspection sheet having plural images formed by using a decolorable developer, each of the images having an image density that differs in a sub-scanning direction of the image forming apparatus. The image reading unit reads an image of the heated inspection sheet and the control unit determines an operative state of each heating element based on the read image.

20 Claims, 12 Drawing Sheets

(56) References Cited

U.S. PATENT DOCUMENTS

| | | | |
|---|---|---|---|
| 2008/0159763 | A1 | 7/2008 | Nakane |
| 2011/0164285 | A1 | 7/2011 | Itagaki |
| 2012/0189340 | A1 | 7/2012 | Hagiwara |
| 2016/0070213 | A1 | 3/2016 | Arima |
| 2019/0294096 | A1 | 9/2019 | Suzuki |

* cited by examiner

IMAGE FORMING APPARATUS, DETERMINATION APPARATUS, AND CONTROL METHOD

CROSS-REFERENCE TO RELATED APPLICATIONS

This application is a continuation of U.S. patent application Ser. No. 16/703,064, filed on Dec. 4, 2019, which application is based upon and claims the benefit of priority from Japanese Patent Application No. 2019-019097, filed on Feb. 5, 2019, the entire contents of which are incorporated herein by reference.

FIELD

Embodiments relate to an image forming apparatus, a determination apparatus, and a control method.

BACKGROUND

An on-demand fixing method has been proposed as a technique for reducing power consumption in an image forming apparatus. In the on-demand fixing method, a film is driven by a rotating member provided with an elastic layer, and a conveyed sheet and developer are heated by a heater through the film. In recent years, a configuration in which a plurality of heaters are arranged in a main scanning direction instead of a single heater has begun to be adopted.

A heater element (or heating element) typically has a long life. In order to prevent the occurrence of improper image formation by sudden disconnection when the service life of the heating element has reached its end, it is necessary to replace the heating element earlier than its service life. Therefore, a heating element that is operating properly and can still be used is discarded, so that waste is caused. Further, the individual heating elements are deposited on the sheet substrate of the heater, and it is often impossible to replace one heating element by itself. Therefore, when one of the heating elements is to be replaced, the other heating elements on the same sheet substrate are also replaced. As a result, the yield of the image forming apparatus is reduced from what it could actually achieve.

DETAILED DESCRIPTION

According to an embodiment, an image forming apparatus includes a fixing device, an image reading unit located downstream of the fixing device, and a control unit. The fixing device includes a plurality of heating elements arranged in a main scanning direction, a band-shaped thin film which slides on the surface of the heating element while being in contact with the heating element on one side, and a rotatable body configured to press against a surface of the thin film to cause the thin film to rotate. The fixing device heats the plurality of heating elements when an inspection sheet is passed through the fixing device, the inspection sheet having plural images formed by using a developer that becomes decolored when subject to heating, each of the images having an image density that differs in a sub-scanning direction of the image forming apparatus. The image reading unit reads an image of the heated inspection sheet and the control unit determines an operative state of each of the plurality of heating elements based on the read image.

Figure 1:
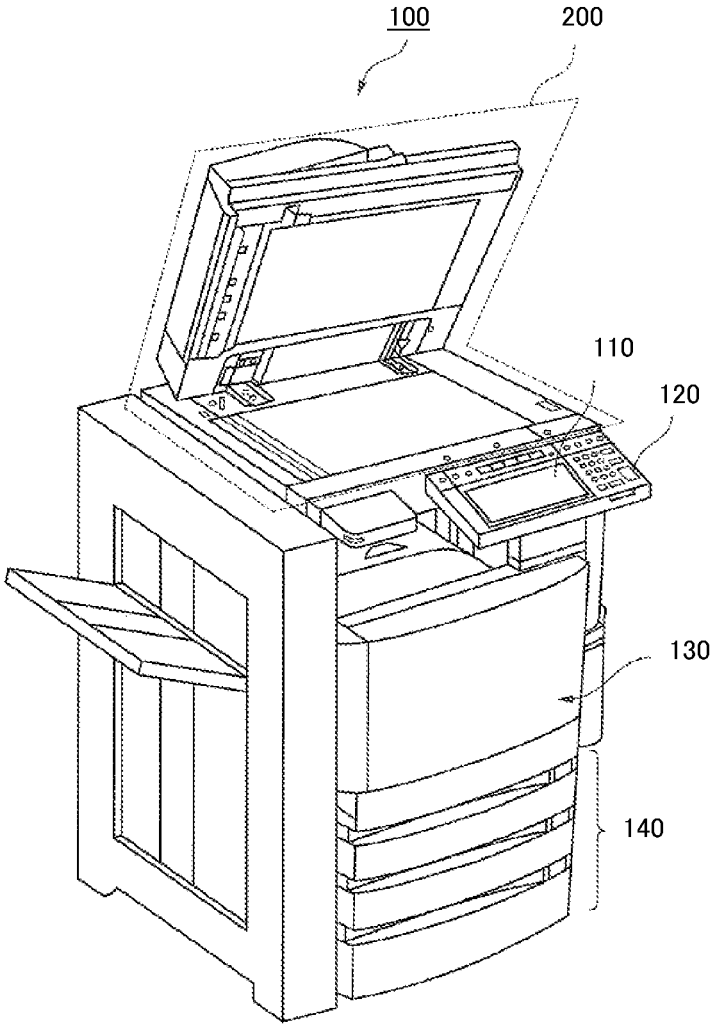
FIG. 1 is an external view showing an example of the overall configuration of an image forming apparatus according to an embodiment.
Figure 2:
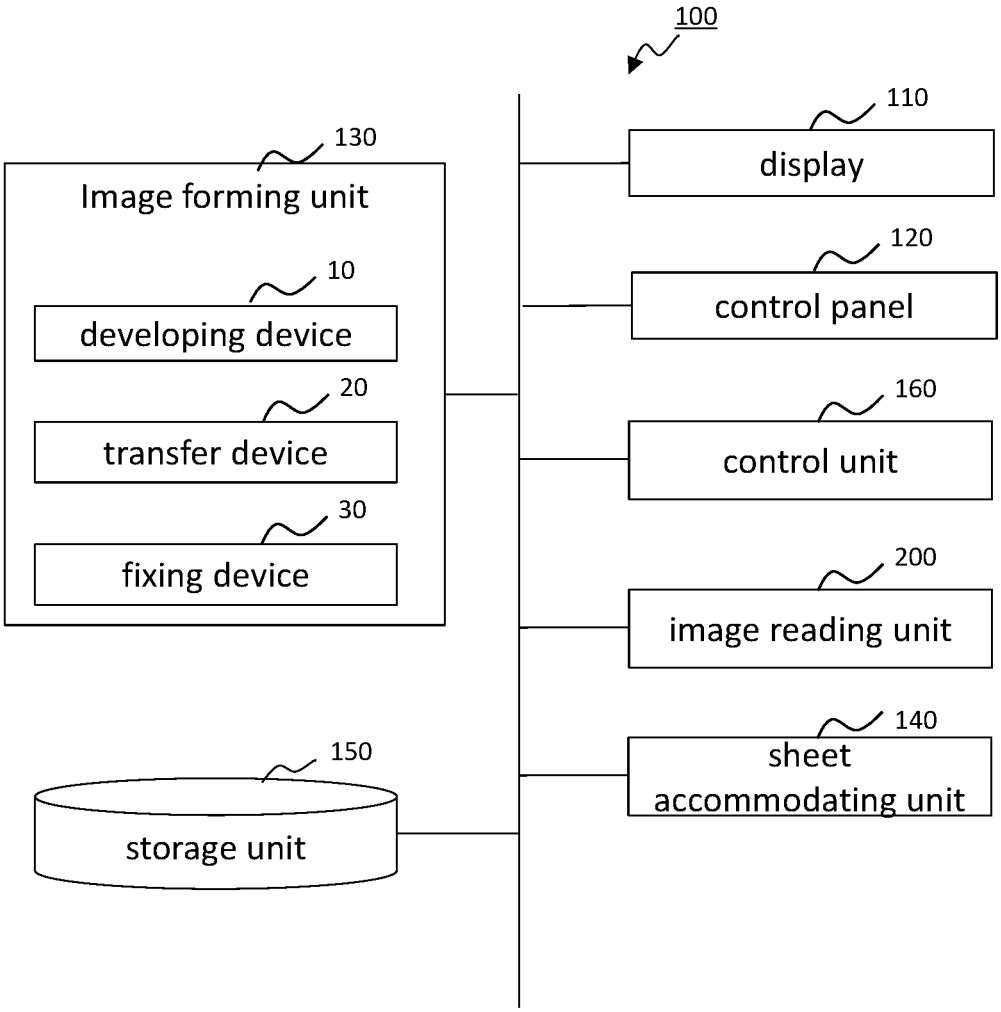
FIG. 2 is a hardware block diagram of an image forming apparatus according to an embodiment.

Hereinafter, an image forming apparatus, a determining apparatus and a control method according to an embodiment will be described with reference to the accompanying drawings. FIG. 1 is an external view showing an example of the overall configuration of the image forming apparatus 100 according to the embodiment. FIG. 2 is a hardware block diagram of the image forming apparatus 100 according to the embodiment. The image forming apparatus 100 is, for example, a multifunction peripheral (MFP). The image forming apparatus 100 includes a display 110, a control panel 120, an image forming unit 130, a sheet accommodating unit 140, a storage unit 150, a control unit 160, and an image reading unit 200.

The image forming apparatus 100 forms an image on a sheet by using a developer such as toner. The developer is fixed on the sheet by being heated. The sheet may be, for example, standard print paper or label paper. The sheet may be any material as long as the image forming apparatus 100 can form an image on the surface thereof.

The display 110 is an image display device such as a liquid crystal display, an organic EL (Electro Luminescence) display, or the like. The display 110 displays various pieces of information related to the image forming apparatus 100.

The control panel 120 is provided with a plurality of buttons. The control panel 120 accepts an operation performed by the user. The control panel 120 outputs a signal corresponding to the operation performed by the user to the control unit 160 of the image forming apparatus 100. Note that the display 110 and the control panel 120 may be configured as a single touch panel.

The image forming unit 130 forms an image on a sheet based on image information generated by the image reading unit 200 or image information received via a communication network. The image forming unit 130 includes, for example, a developing device 10, a transfer device 20, and a fixing device 30. The image forming unit 130 forms an image by, for example, the following steps. The developing device 10 of the image forming unit 130 forms an electrostatic latent image on the photosensitive drum based on the image information. The developing device 10 of the image forming unit 130 forms a visible image by adhering the developer to the electrostatic latent image. A specific example of the developer is toner. Examples of the toner include a decolorable toner, a non-decolorable toner (ordinary toner), and a decorative toner. Some developers exhibit a reduced color based on an amount of heating applied to the developer. Such a developer is referred to as a "decolorable developer" in the following description. The decolorable toner is a specific example of the decolorable developer.

The transfer device 20 of the image forming unit 130 transfers the visible image onto the sheet. The fixing device 30 of the image forming unit 130 fixes the visible image on the sheet by heating and pressurizing the sheet. The sheet on which the image is formed may be a sheet accommodated in the sheet accommodating unit 140, or may be a manually inserted sheet.

The sheet accommodating unit 140 accommodates a sheet used for image formation in the image forming unit 130.

The storage unit 150 is configured by using a storage device such as a magnetic hard disk device or a semiconductor storage device. The storage unit 150 stores data necessary for the image forming apparatus 100 to operate. The storage unit 150 may temporarily store data of an image formed in the image forming apparatus 100.

The control unit 160 includes a processor such as a CPU (Central Processing Unit) and a memory. The control unit 160 reads out and executes a program stored in the storage unit 150 in advance. The control unit 160 controls the operations of the respective devices included in the image forming apparatus 100.

Figure 3:
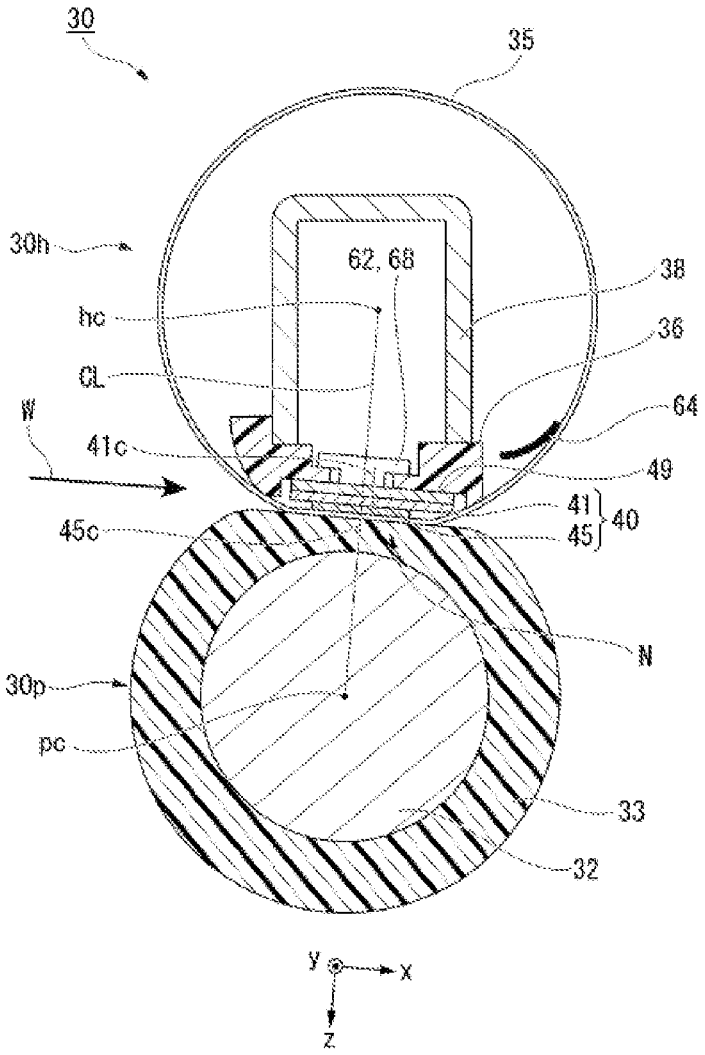
FIG. 3 is a front sectional view of a fixing device in the image forming apparatus according to an embodiment.

The control unit 160 controls the electric power supplied to a heating element set 45 (see also FIG. 3). The power control may be realized by controlling the energization amount of the power supply. The control of the energization amount may be realized by, for example, phase control, or by wave number control.

The image reading unit 200 reads the image information to be read as light data (e.g., bit value "1") and dark data (e.g., bit value "0"). The image reading unit 200 records the image information that has been read. The recorded image information may be transmitted to another information processing apparatus via the network. The recorded image information may be imaged onto the sheet by the image forming unit 130. The image reading unit 200 may include an automatic document feeder (ADF).

FIG. 3 is a front sectional view of the fixing device 30 according to the embodiment. The fixing device 30 of the embodiment includes a pressure roller 30*p* and a film unit 30*h*.

The pressure roller 30*p* can press and drive the surface of the film unit 30*h*. When the surface is pressed against the film unit 30*h*, the pressure roller 30*p* forms a nip N with the film unit 30*h*. The pressure roller 30*p* pressurizes the visible image of the sheet entering the nip N. When the pressure roller 30*p* is driven to rotate, it conveys the sheet in accordance with rotation of the sheet. The pressure roller 30*p* includes, for example, a core metal 32, an elastic layer 33, and a release layer (not shown).

The core metal 32 is made of a metal material such as stainless steel, and is formed in a cylindrical shape. Both end portions in the axial direction of the core metal 32 are rotatably supported. The core metal 32 is driven to rotate by a motor (not shown). The core metal 32 comes into contact with a cam member (not shown).

The elastic layer 33 is formed of an elastic material such as silicone rubber. The elastic layer 33 is formed to have a constant thickness on the outer peripheral surface of the core metal 32. A release layer (not shown) is formed on the outer peripheral surface of the elastic layer 33. The release layer is formed of a resin material such as PFA (tetrafluoroethylene perfluoroalkyl vinyl ether copolymer).

The pressure roller 30*p* is rotated by a motor. When the pressure roller 30*p* rotates in the state where the nip N is formed, the cylindrical film 35 of the film unit 30*h* is driven to rotate. The pressure roller 30*p* conveys the sheet in the conveying direction W by rotating the sheet in a state where the sheet is placed in the nip N.

The film unit 30*h* heats the visible image of the sheet that has entered into the nip N. The film unit 30*h* includes a cylindrical film 35, a heater unit 40, a heat transfer member 49, a support member 36, a stay 38, a heater thermometer 62, a thermostat 68, and a film thermometer 64.

The cylindrical film 35 is formed in a cylindrical shape. The cylindrical film 35 is provided with a base layer, an elastic layer, and a release layer in this order from the inner peripheral side. The base layer is formed in a cylindrical shape by a material such as nickel (Ni) or the like. The elastic layer is laminated and arranged on the outer peripheral surface of the base layer. The elastic layer is formed of an elastic material such as silicone rubber. The release layer is laminated and arranged on the outer peripheral surface of the elastic layer. The release layer is formed of a material such as a perfluoroalkoxy alkane (PFA) resin.

Figure 4:
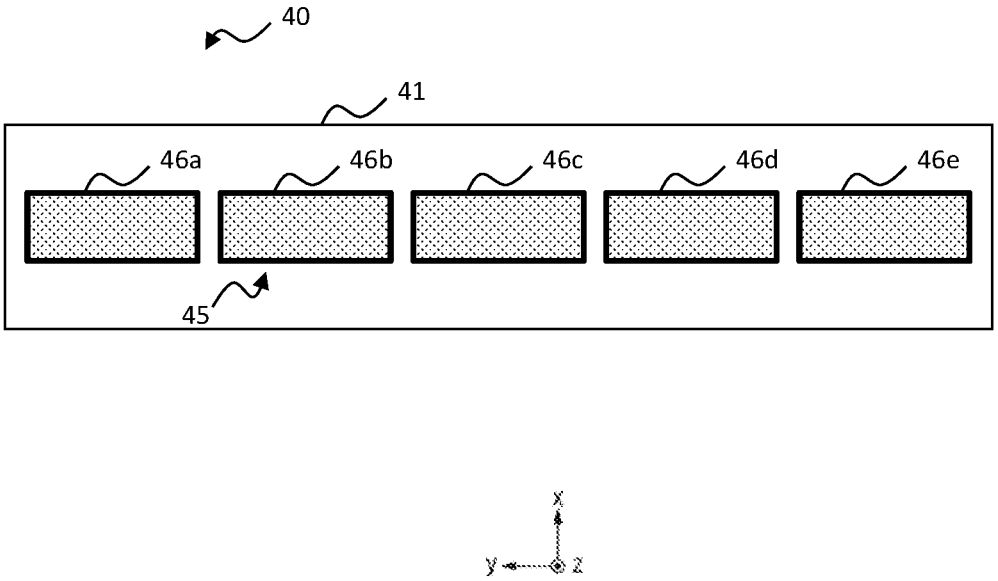
FIG. 4 is a schematic diagram of a heater unit in the fixing device.

FIG. 4 is a schematic diagram of the heater unit 40. The heater unit 40 includes a substrate (heat generating element substrate) 41 and a heating element set 45. The substrate 41 is made of a metal material such as stainless steel or nickel, a ceramic material such as aluminum nitride, or the like. The substrate 41 is formed in a long rectangular plate shape. The substrate 41 is disposed inside the cylindrical film 35 in the radial direction. In the substrate 41, the axial direction of the cylindrical film 35 is taken as the longitudinal direction.

A heating element set 45 is formed on the surface of the substrate 41. The heating element set 45 is provided with a plurality of heating elements 46. Each of the heating elements 46 is formed by using a heating resistor such as a silver-palladium alloy. In the example shown in FIG. 4, the heating element set 45 includes 5 heating elements 46 (46*a*-46*e*). The energization amount of each of the heating elements 46 is independently controlled by the control unit 160.

As shown in FIG. 3, the heater unit 40 is disposed inside the cylindrical film 35. A lubricant (not shown) is applied to the inner peripheral surface of the cylindrical film 35. The heater unit 40 comes into contact with the inner peripheral surface of the cylindrical film 35 through a lubricant. When the heater unit 40 generates heat, the viscosity of the lubricant decreases. Thus, the sliding property between the heater unit 40 and the cylindrical film 35 is secured. In this manner, the cylindrical film 35 is a band-shaped thin film which slides on the surface of the heater unit 40 while making contact with the heater unit 40 on one surface.

The support member 36 is made of a resin material such as a liquid crystal polymer. The support member 36 supports the heater unit 40. The support member 36 supports the inner peripheral surface of the cylindrical film 35 at both end portions of the heater unit 40.

The stay 38 is formed of a steel sheet material or the like. The cross section of the stay 38 may be formed, for example, in a U-shape. The stay 38 is mounted so as to block the opening of the U with the support member 36. Both end portions of the stay 38 are fixed to the housing of the image forming apparatus 100. As a result, the film unit 30*h* is supported by the image forming apparatus 100.

The heater thermometer 62 is disposed in the vicinity of the heater unit 40. The heater thermometer 62 measures the temperature of the heater unit 40.

The thermostat 68 is arranged in the same manner as the heater thermometer 62. When the temperature of the heater unit 40 exceeds a predetermined temperature, the thermostat 68 cuts off the power supply to the heating element set 45.

Figure 5:
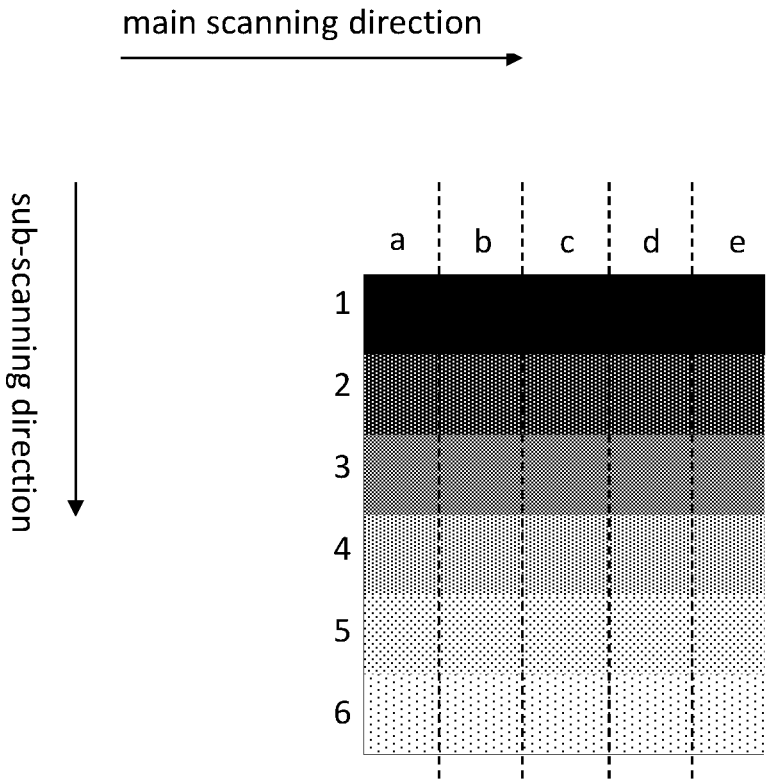
FIG. 5 is a diagram showing a specific example of an inspection sheet used in an embodiment.

FIG. 5 is a diagram showing a specific example of an inspection sheet that may be used according to one or more embodiments to determine the operative state of the heating elements 46. The inspection sheet is a sheet in which an image using a decolorable developer is formed at substantially the same density in the main scanning direction. The image in the main scanning direction formed on the inspection sheet is determined in accordance with the width in the main scanning direction of the fixing device 30 of the image forming apparatus 100 to be inspected. For example, an image may be formed so as to have substantially the same width as the width from one end to the other end of the heating element set 45 of the fixing device 30. A specific example will be described with reference to FIGS. 4 and 5. The inspection sheet is formed when the inspection sheet passes through the fixing device 30 so that the image of column a of the inspection sheet passes through the heating element 46*a*, the image of column b of the inspection sheet passes through the heating element 46*b*, the image of column c of the inspection sheet passes through the heating element 46*c*, the image of column d of the inspection sheet passes through the heating element 46*d*, and the image of column e of the inspection sheet passes through the heating element 46*e*.

In the example of the inspection sheet shown in FIG. 5, images of a plurality of types are formed in the sub-scanning direction in each column (column a-column e). For example, the image is formed to be gradually decolored in a direction from the first row to the six row.

Next, an inspection method using an inspection sheet will be described. The inspection sheet passes through the heated fixing device 30. When the inspection sheet is heated by the fixing device 30 as described above, the image formed on the inspection sheet is decolored. When the inspection using the inspection sheet is performed as described above, the fixing device 30 is controlled by the energization amount (hereinafter, referred to as "inspection energization amount") which becomes a temperature at which the image having the highest density is not completely (sufficiently) decolored in the inspection sheet. For example, the fixing device 30 may be controlled by the control unit 160 to a power supply amount of about 50% of the maximum energization amount. In this manner, an operation mode (hereinafter referred to as "inspection mode") for performing the inspection using the inspection sheet may be set in the image forming apparatus 100 in advance. Based on the inspection sheet heated by the fixing device (hereinafter referred to as "post-heating inspection sheet"), the operative state of each heating element 46*a*-46*e* of the fixing device 30 is determined.

Figure 6:
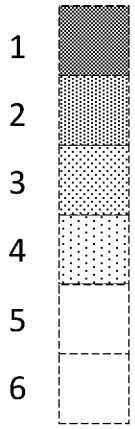
FIG. 6 is a diagram showing a specific example of reference information that may be utilized according to an embodiment.

FIG. 6 is a diagram showing a specific example of the reference information. The reference information indicates image information (for example, a value indicating density) of each row assumed in the post-heating inspection sheet heated by the fixing device 30 operating normally. Therefore, when the image on the post-heating inspection sheet used in the image forming apparatus 100 to be inspected is substantially the same as the image indicated by the reference information, it is found that the fixing device 30 is normal.

The control unit 160 of the image forming apparatus 100 operates in the determination mode to determine whether or not a failure of the heating element 46 has occurred. When the image forming apparatus 100 is operated in the determination mode, the control unit 160 of the image forming apparatus 100 reads an image of the inspection sheet by the image reading unit 200 after the heating. The control unit 160 determines the operative state of the fixing device 30 of the image forming apparatus 100 to be inspected based on the read image (hereinafter, referred to as "post-heating image") and the reference information. For example, an operative state (e.g., normal state or failed state) of each of the heating elements 46 of the image forming apparatus 100 may be determined by comparing the reference information with reference information for each row in the main scanning direction after heating. When the post-heating inspection sheet heated by the own apparatus is used, the control unit 160 may determine correction information of the heating element 46 of the own apparatus.

Figure 7:
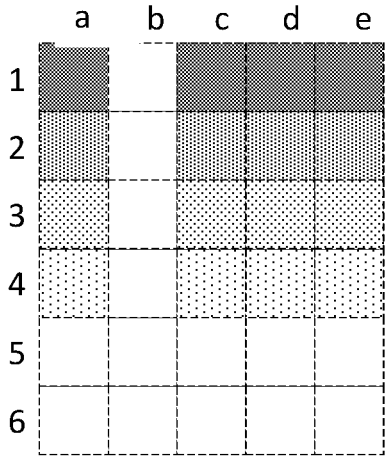
FIG. 7 is a diagram showing one example of a post-heating image.

FIG. 7 is a diagram illustrating one specific example of the post-heating image. In FIG. 7, the image in the column b is excessively decolored in each row, and almost no color remains. In FIG. 7, information (hereinafter referred to as "difference information") indicating the difference between the color of the image in the column b and the color in the reference information satisfies the predetermined first condition. The difference information may be, for example, a pixel value or a density difference, or may be a pixel value or a density ratio. The difference information may be any information as long as it is an index capable of evaluating a difference in color. The first condition is a condition related to the difference information, and is a condition that it is determined to be a failure due to a large difference in the degree to which the correction cannot be performed. Therefore, the heating element 46*b* of the fixing device 30 of the image forming apparatus 100 is in a failure state because the difference is too large, and it is determined that replacement of heating element 46*b* is necessary. Since the images of the column a, the column c, the column d, and the column e are substantially the same as the reference information, the heating elements 46*a*, 46*c*, 46*d*, and 46*e* are determined to be normal. However, in the present embodiment, since a plurality of heating element sets 45 are formed on the same substrate 41, the individual heating element 46*b* cannot be replaced while at the same time keeping the normal-operating heating elements 46*a*, 46*c*, 46*d*, 46*e*. Therefore, in the present embodiment, when it is determined that one of the heating elements 46 has failed, the user is instructed to replace the entire heater unit 40. On the other hand, in a case where the heating elements 46*a*, 46*b*, 46*c*, 46*d*, 46*e* can be individually replaced within the heating unit 40, this embodiment also enables a service person to replace the failed heating element 46*b*, while at the same time keeping the normally operating elements 46*a*, 46*c*, 46*d*, 46*e*.

Figure 8:
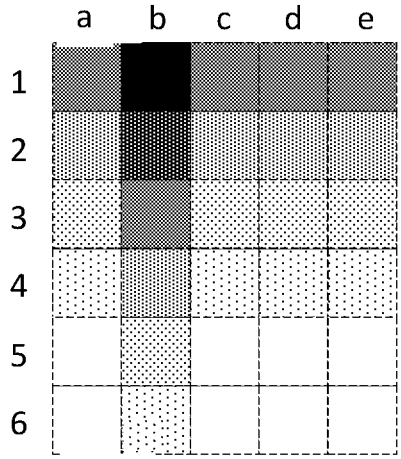
FIG. 8 is a diagram showing one example of a post-heating image.

FIG. 8 is a diagram illustrating one example of a specific example of the post-heating image. In FIG. 8, the color erasure for the image in the column b is insufficient in each row, and the color remains in a state in which the density is high. In FIG. 8, the difference information indicating the difference between the density of the image in the column b and the density of the reference information satisfies the predetermined first condition. Therefore, the heating element 46*b* of the fixing device 30 of the image forming apparatus 100 is in a failure state because the difference is too large, and it is determined that the replacement is necessary. Since the images of the column a, the column c, the column d, and the column e are substantially the same as the reference information, the heating elements 46*a*, 46*c*, 46*d*, and 46*e* are determined to be normal. However, in the present embodiment, since the heating element 46*b* is judged to be in a failed state for the reason described above, and in a case in which the failed heating element 46*b* cannot be replaced while at the same time keeping the normally operating heating elements 46*a*, 46*c*, 46*d*, 46*e*, replacement of the entire heater unit 40 is instructed to the user. On the other hand, in a case where the heating elements 46*a*, 46*b*, 46*c*, 46*d*, 46*e* can be individually replaced within the heating unit 40, this embodiment also enables a service person to replace the failed heating element 46*b*, while at the same time keeping the normally operating elements 46*a*, 46*c*, 46*d*, 46*e*.

Figure 9:
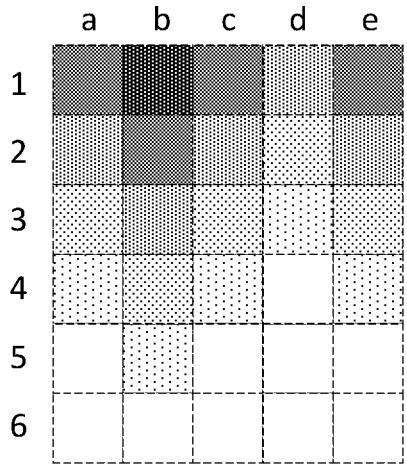
FIG. 9 is a diagram showing one example of a post-heating image.

FIG. 9 is a diagram illustrating one example of a specific example of the post-heating image. In FIG. 9, the image in column b is slightly darker than the normal column in each row of column b, and the image in column d is slightly stronger in color than the normal column in each row of column d. In FIG. 9, the difference information indicating the difference between the color of the image of the column b and the color of the reference information satisfies a predetermined second condition. The second condition is a condition relating to the difference information, and since there is a difference in degree to be corrected, it is a condition that it is determined that the correction is required in the control in the control. Therefore, regarding the heating element 46*b* of the fixing device 30, correction information is determined. The correction information may be determined as, for example, information indicating an increase or decrease in the amount of energization. For example, the correction information determines the correction information so that the density (color) of the post-heating image coincides with the reference information. The value of the correction information may be stored in the storage unit 150 in association with the degree of the difference indicated by the difference information, for example. For example, correction information of the entire heating element set 45 may be generated by arranging the correction information values (for example, represented by 2 bits) along the order of the heating elements 46*a*-46*e*. In this case, for example, it indicates that "00" is normal and correction is not required, and "10" is necessary to be corrected so that the heating becomes lower (such that the amount of energization becomes smaller), and it is necessary to correct the "01" so that the heating becomes higher (such that the amount of energization is increased), and these values may be aligned.

In the heating element 46*d* of the fixing device 30 of the image forming apparatus 100 in which the post-heating image shown in FIG. 9 is generated, the correction information is determined so that the output is smaller than that in the inspection. The determined correction information is registered in the storage unit 150. The control unit 160 controls the energization amount of each heating element 46 based on the correction information registered in the storage unit 150 in a subsequent normal operation (for example, an image forming operation). By such an operation, variations in output for each of the heating elements 46 are corrected, so that an image formation with better accuracy can be realized.

Figure 10:
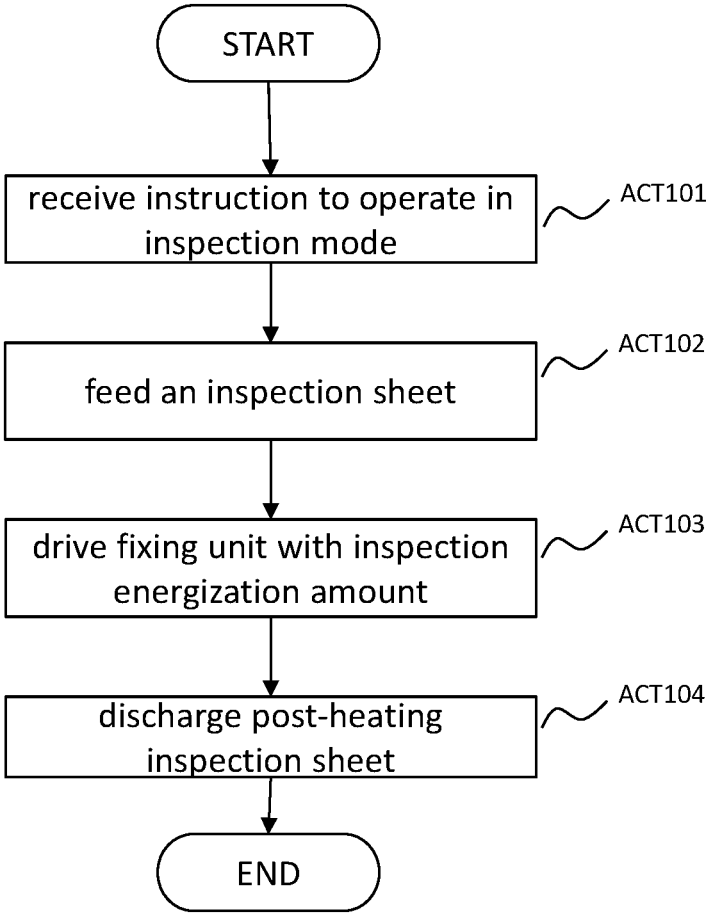
FIG. 10 is a flowchart showing a specific example of the flow of the operation of an image forming apparatus to be inspected, according to an embodiment.

FIG. 10 is a flowchart showing a specific example of the flow of the operation of an image forming apparatus 100 to be inspected, according to an embodiment. In ACT101, the control panel 120 of the image forming apparatus 100 is operated by the user to set the image forming apparatus 100 in the inspection mode (ACT101). Thereafter, the inspection sheet is placed in a state in which the sheet can be fed. For example, an inspection sheet is placed in the manual feed tray or the sheet accommodating unit 140. After that, when the start operation is performed by the user, the control unit 160 feeds the inspection sheet (ACT102). In response to the inspection mode being set in the inspection mode, the control unit 160 controls the heating elements 46 of the fixing device 30 with the amount of electric current to be tested (ACT103). Then, the control unit 160 controls the rollers in the image forming apparatus 100 to control the inside of the fixing device 30 that is heated by the inspection energization amount to pass through the inspection sheet. After that, the post-heating inspection sheet is discharged to the sheet discharge tray (ACT104). By viewing the post-heating inspection sheet discharged in this manner, it is also possible for the user to judge the failure of the heating element 46 of the image forming apparatus 100.

Figure 11:
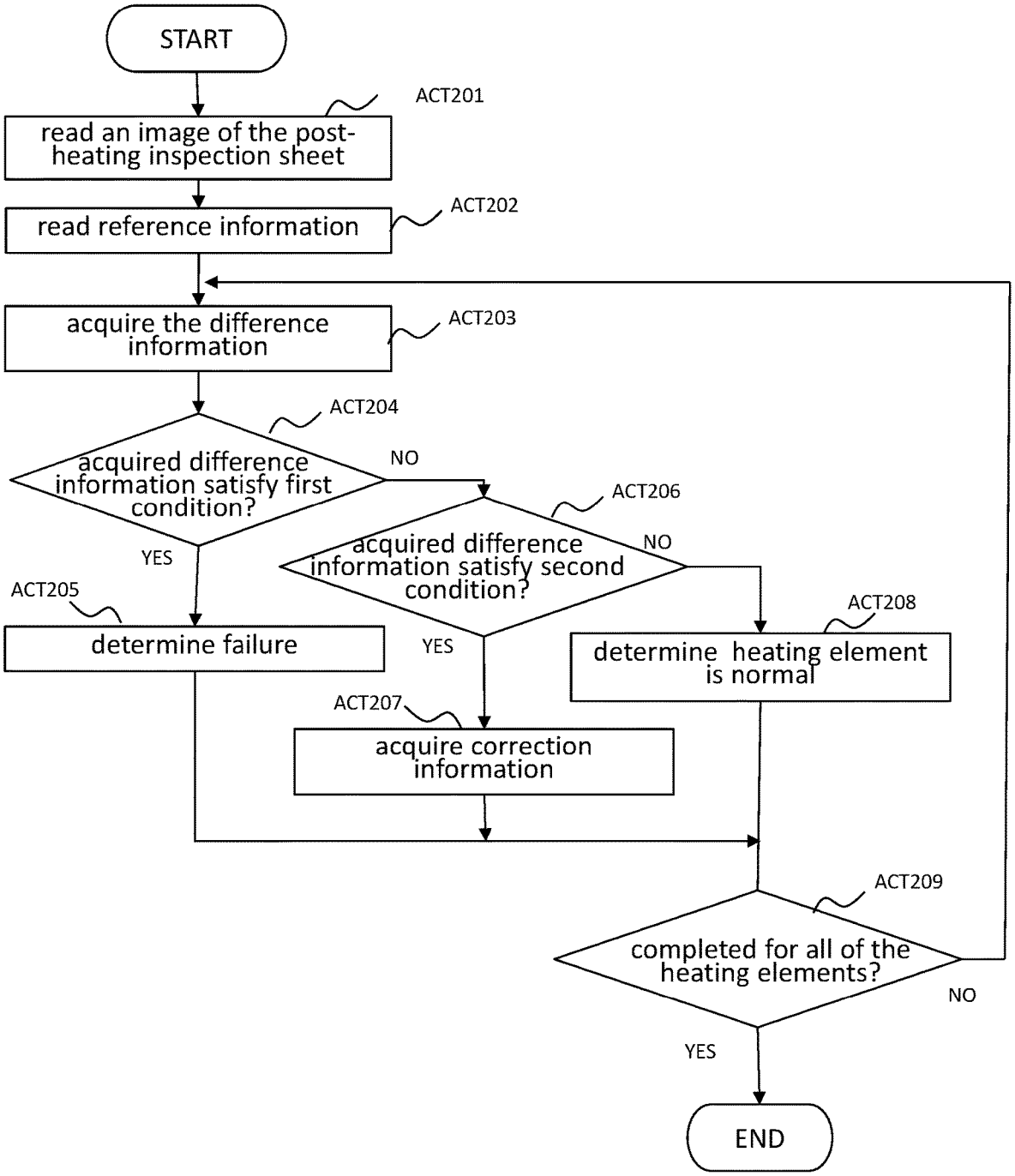
FIG. 11 is a flowchart illustrating a specific example of a determination process performed by an image forming apparatus to be inspected, according to an embodiment.

FIG. 11 is a flowchart showing a specific example of the determination processing by the image forming apparatus 100 to be inspected. When the control panel 120 of the image forming apparatus 100 is operated by the user, it is set to operate in the determination mode. After that, the post-heating inspection sheet is placed in a state in which the sheet can be fed to the image reading unit 200. For example, the post-heating inspection sheet may be disposed on the ADF of the image reading unit 200, or may be disposed on a reading surface formed of glass or the like. After that, when the start operation is performed by the user, the image reading unit 200 reads an image (a post-heating image) of the post-heating inspection sheet (ACT201).

The control unit 160 records the data of the post-heating image read by the image reading unit 200 in the storage unit 150. The control unit 160 reads out the reference information stored in the storage unit 150 in advance (ACT202). The control unit 160 reads an image of an area corresponding to the heating element 46 to be a determination target from the post-heating image stored in the storage unit 150. For example, when the heating element 46 to be a determination object is the heating element 46*a*, the control unit 160 reads the image of the column a from the post-heating image. Then, the control unit 160 acquires the difference information based on the read post-heating image and the reference information (ACT203).

The control unit 160 determines whether or not the acquired difference information satisfies the first condition (ACT204). When the difference information satisfies the first condition (ACT204—YES), the control unit 160 determines that the heating element 46 which is a determination target is a failure and needs to be replaced (ACT205). The control unit 160 records information indicating the determination result to the storage unit 150 in association with identification information indicating the heating element 46 which is a determination target.

When the difference information does not satisfy the first condition (ACT204—NO), the control unit 160 determines whether or not the acquired difference information satisfies the second condition (ACT206). When the difference information satisfies the second condition (ACT206—YES), the control unit 160 determines that there is no need to exchange the heating element 46 which is the object to be determined, but requires correction to the amount of energization. In this case, the control unit 160 acquires the correction information of the heating element based on the difference information (ACT207). The control unit 160 records information indicating the determination result to the storage unit 150 in association with identification information indicating the heating element 46 which is a determination target.

When the difference information does not satisfy both the first condition and the second condition (ACT206—NO), the control unit 160 determines that the heating element 46 is normal for the determination object (ACT208). Thereafter, until the determination is completed for all of the heating elements 46, the control unit 160 repeatedly executes the processing of the ACT203-ACT208 for each of the heating elements 46 (ACT209—NO).

When the determination is completed for all of the heating elements 46 (ACT209—YES), the control unit 160 displays characters or images indicating the determination result on the display 110. For example, when it is determined that one or more heating elements 46 are failed, the control unit 160 may display a character or an image for recommending replacement of the heater unit 40 on the display 110. For example, when there is no heating element 46 determined to be a failure, but the correction information is acquired for one or more heating elements 46, the control unit 160 may display on the display 110 a character or image indicating that the control of the heating element 46 has been completed. For example, when there is no heating element 46 determined to be in a failed state and there is no heating element 46 in which correction information is acquired, the control unit 160 may display characters or images indicating that all of the heating elements 46 are normal on the display 110.

All or a part of the operation of the control unit 160 may be realized by using hardware such as an ASIC (Application Specific Integrated Circuit), a PLD (Programmable Logic Device), or an FPGA (Field Programmable Gate Array). The program may be recorded on a computer-readable recording medium. The computer-readable recording medium is, for example, a flexible disk, a magneto-optical disk, a portable medium such as a ROM, a CD-ROM, or the like, a storage device such as a hard disk incorporated in a computer system, or the like. The program may be transmitted over a telecommunications line.

According to at least one embodiment described above, it is possible to determine the operative state of the heating element 46 of the image forming apparatus 100 based on the post-heating image generated by heating the inspection sheet by the image forming apparatus 100. Further, based on the difference information between the post-heating image and the reference image, correction information of control for operating each of the heating elements 46 in a state that is closer to the normal state may be acquired. In this case, the control unit 160 of the image forming apparatus 100 controls each of the heating elements 46 based on the acquired correction information. By performing such control as described above, it is possible to continue to use the heater unit 40, which has a difference in calorific value, and to improve the yield.

Modified Example

Figure 12:
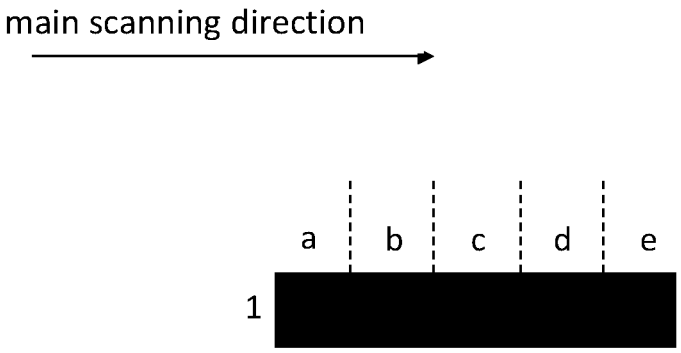
FIG. 12 is a diagram showing a modification example of an inspection sheet used in an embodiment.

FIG. 12 is a diagram showing a modification example of the inspection sheet. In the embodiment described above, a plurality of columns are set in the inspection sheet, and images having different densities are formed in each column. However, as shown in FIG. 12, an inspection sheet may be formed of images having the same density in each column (along a sub-scanning direction when the inspection sheet is placed in the image processing apparatus 100).

Among the processing of the control unit 160 in the embodiment described above, the processing for determining the operative state of each heating element 46 based on the post-heating image and the processing for acquiring the correction information may be executed in the information processing apparatus (also referred to herein as a determination apparatus) instead of the image forming apparatus 100. For example, the determination apparatus that received the post-heating image via the network may perform judgment of the operative state and acquisition of correction information, and may transmit the determination result to the apparatus (for example, the image forming apparatus 100) that is the transmission source of the post-heating image.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The embodiments and variations thereof are included within the scope and spirit of the invention, and are included within the scope of the appended claims and their equivalents.

What is claimed is:

1. An image forming apparatus, comprising:

a heater arranged in a main scanning direction of the image forming apparatus;

a film configured to slide on an outer surface of the heater;

a rotatable member configured to press against a surface of the film;

an image reading unit; and a control unit configured to:

control the heater to heat an inspection sheet passing through a nip between the film and the rotatable member, the inspection sheet having an image formed thereon using a developer that becomes decolored by heating, the image having image density differences in a sub-scanning direction, control the image reading unit to read the image on the heated inspection sheet, and determine an operative state of the heater based on the image read by the image reading unit.

2. The image forming apparatus according to claim 1, wherein the image extends in the sub-scanning direction.

3. The image forming apparatus according to claim 2, wherein the image is formed at a first position with a first image density, a second position with a second image density less than the first image density, and a third position with a third image density less than the second image density.

4. The image forming apparatus according to claim 3, wherein the first position, the second position and the third position are aligned with respect to the main scanning direction.

5. The image forming apparatus according to claim 4, wherein the first position is adjacent to the second position in the sub-scanning direction, and the second position is adjacent to the third position in the sub-scanning direction.

6. The image forming apparatus according to claim 3, wherein a color of the image at the first position is black, and colors of the image at the second and third positions are not black.

7. The image forming apparatus according to claim 1, wherein the heater comprises a plurality of heating elements arranged in the main scanning direction.

8. The image forming apparatus according to claim 7, wherein the control unit determines an operative state of a heating element to be in a failed state if the read image at a position corresponding to the heating element contains an image density that is greater than or less than a reference image density by greater than or equal to a threshold amount.

9. The image forming apparatus according to claim 8, wherein the control unit determines an operative state of each of the heating elements based on a plurality of images read by the image reading unit.

10. The image forming apparatus according to claim 1, further comprising:

an image forming unit configured to form the image, wherein the image formed by the image forming unit is fixed on the sheet by the nip between the film and the rotatable member.

11. A method for determining an operative state of a heater of an image forming apparatus, the heater being arranged in a main scanning direction of the image forming apparatus, and the image forming apparatus comprising a film configured to slide on an outer surface of the heater and a rotatable member configured to press against a surface of the film, the method comprising:

heating an inspection sheet passing through a nip between the film and the rotatable member;

forming an image on the inspection sheet using a developer that becomes decolored by heating, the image having image density differences in a sub-scanning direction;

reading the image on the heated inspection sheet; and determining the operative state of the heater based on the image read from the heated inspection sheet.

12. The method according to claim 11, wherein the image extends in the sub-scanning direction.

13. The method according to claim 12, wherein the image is formed at a first position with a first image density, a second position with a second image density less than the first image density, and a third position with a third image density less than the second image density.

14. The method according to claim 13, wherein the first position, the second position and the third position are aligned with respect to the main scanning direction.

15. The method according to claim 14, wherein the first position is adjacent to the second position in the sub-scanning direction, and the second position is adjacent to the third position in the sub-scanning direction.

16. The method according to claim 13, wherein a color of the image at the first position is black, and colors of the image at the second and third positions are not black.

17. The method according to claim 11, wherein the heater comprises a plurality of heating elements arranged in the main scanning direction.

18. The method according to claim 17, further comprising:

determining an operative state of a heating element to be in a failed state if the read image at a position corresponding to the heating element contains an image density that is greater than or less than a reference image density by greater than or equal to a threshold amount.

19. The method according to claim 18, further comprising:

determining an operative state of each of the heating elements based on a plurality of images read from the heated inspection sheet.

20. The method according to claim 11, wherein the image formed on the inspection sheet is fixed on the sheet by the nip between the film and the rotatable member.

* * * * *